US006490754B1

(12) United States Patent
Spaulding

(10) Patent No.: US 6,490,754 B1
(45) Date of Patent: Dec. 10, 2002

(54) LOW PRESSURE AIR CLEANING SYSTEM

(76) Inventor: Raymond E. Spaulding, 8110 Manitoba St. #215, Playa Del Rey, CA (US) 90293

( * ) Notice: Subject to any disclaimer, the term of this patent is extended or adjusted under 35 U.S.C. 154(b) by 0 days.

(21) Appl. No.: 10/056,509

(22) Filed: Jan. 25, 2002

(51) Int. Cl.[7] ..... A47L 5/14; A47L 5/24; A47L 9/00

(52) U.S. Cl. ..... 15/323; 15/344; 15/405

(58) Field of Search ..... 15/323, 344, 405; 417/234

(56) References Cited

U.S. PATENT DOCUMENTS 3,430,811 A * 3/1969 Nystrom ..... 15/405
4,237,576 A * 12/1980 Stakes ..... 15/344
4,636,230 A * 1/1987 Fan ..... 15/328
4,656,687 A * 4/1987 Wei ..... 15/324
4,789,310 A * 12/1988 Hung ..... 15/339
4,829,625 A * 5/1989 Wang ..... 15/330
5,332,222 A * 7/1994 Perry ..... 15/339
5,335,703 A * 8/1994 deJong ..... 134/102.2

* cited by examiner

*Primary Examiner*—Chris K. Moore
(74) *Attorney, Agent, or Firm*—Goldstein & Lavas, P.C.

(57) ABSTRACT

A low pressure air cleaning system that allows a surface to be cleaned easily by blowing particulate matter from the surface including a housing defined by a top wall, a bottom wall, a front wall, a back wall, a first end wall, and a second end wall. A motor is disposed within the housing. The motor has a power cord extending outwardly of the first end wall of the housing. The motor includes an air intake. The air intake has an open outer end extending outwardly of the first end wall. The motor includes an air outlet. An air compression tank is disposed within the housing. The air compression tank has an air inlet in communication with the air outlet of the motor. The air compression tank has an air outlet. A regulator is disposed within the housing. The regulator has an air inlet in communication with the air outlet of the air compression tank. The regulator includes an air outlet extending outwardly of the second end wall of the housing. An air hose is adapted for coupling with the air outlet of the regulator.

11 Claims, 4 Drawing Sheets

LOW PRESSURE AIR CLEANING SYSTEM

BACKGROUND OF THE INVENTION

The invention relates to a low pressure air cleaning system that allows a surface to be cleaned easily by blowing particulate matter from the surface.

Several references show various cleaning devices. U.S. Pat. No. 6,094,773 to Krentz discloses a portable cleaning device capable of providing various functions and includes an air compressor for spraying compressed air. U.S. Pat. No. 5,400,462 to Amoretti discloses a multi-purpose cleaning appliance that is capable of generating a jet of air. U.S. Pat. No. 5,457,846 to Kuwano discloses a portable blower assembly, powered by an internal combustion engine. U.S. Pat. No. 2,299,987 to Hunter discloses a portable cleaning unit using air under pressure.

While these units may be suitable for the particular purpose employed, or for general use, they would not be as suitable for the purposes of the present invention as disclosed hereafter.

SUMMARY OF THE INVENTION

It is an object of the invention to produce a low pressure air cleaning system that allows a surface to be cleaned easily by blowing particulate matter from the surface including a housing having a generally rectangular configuration defined by a top wall, a bottom wall, a front wall, a back wall, a first end wall, and a second end wall. The housing has a hollow interior. The top wall has a generally L-shaped handle extending upwardly therefrom. The bottom wall has a plurality of support feet extending downwardly therefrom. The first and second end walls each have a removable cover member coupled thereto. A motor is disposed within the hollow interior of the housing. The motor has a power cord extending outwardly of the first end wall of the housing. The power cord includes a cord mount secured to the first end wall for wrappedly receiving the power cord thereon. The motor includes an air intake. The air intake has an open outer end extending outwardly of the first end wall. The motor includes an air outlet. The motor has a power switch disposed in the top wall of the housing. An air compression tank is disposed within the hollow interior of the housing. The air compression tank has an air inlet in communication with the air outlet of the motor. The air compression tank has an air outlet. A regulator is disposed within the hollow interior of the housing. The regulator has an air inlet in communication with the air outlet of the air compression tank. The regulator includes an air outlet extending outwardly of the second end wall of the housing. The regulator includes a control valve and pressure gauge disposed within the top wall of the housing. An air hose is adapted for coupling with the air outlet of the regulator. The air hose includes a cord mount secured to the second end wall for wrappedly receiving the air hose thereon. The air hose includes a plurality of nozzle attachments adapted for being removably coupled therewith. The nozzle attachments include clips secured to the front and back walls of the housing for receiving the nozzle attachments when not in use.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
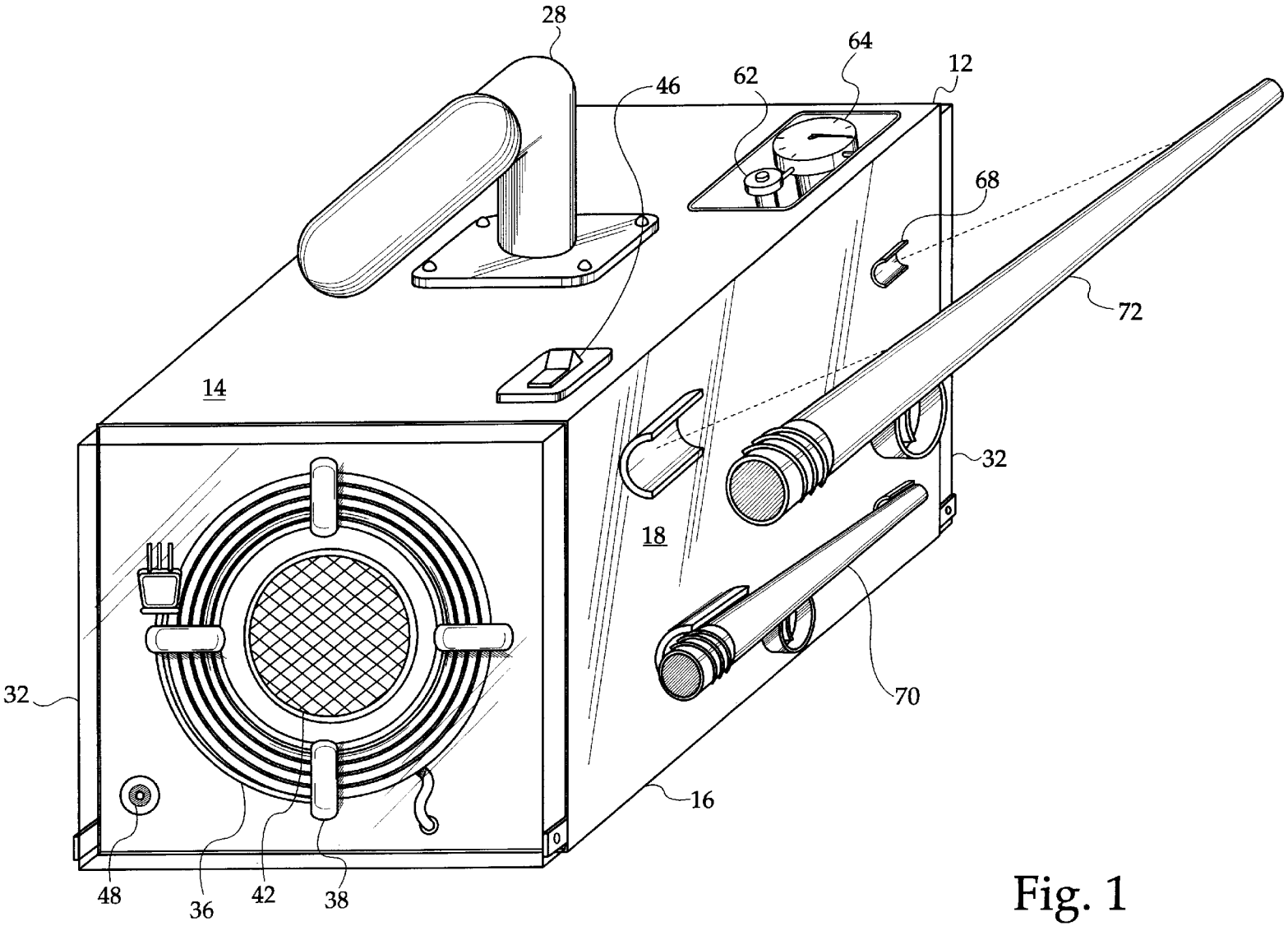
FIG. 1 is a top perspective view of the present invention.
Figure 2:
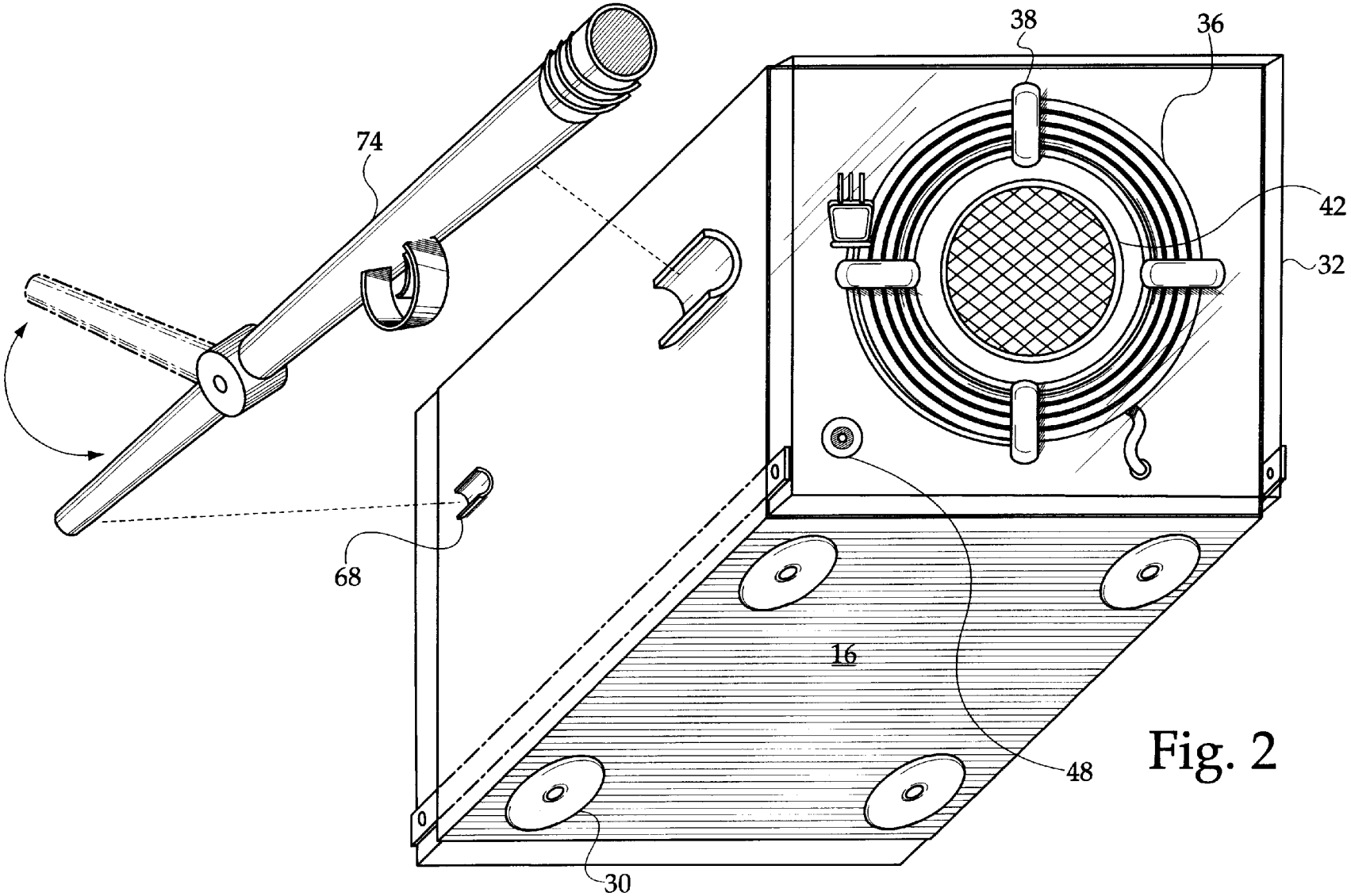
FIG. 2 is a bottom perspective view of the present invention.
Figure 3:
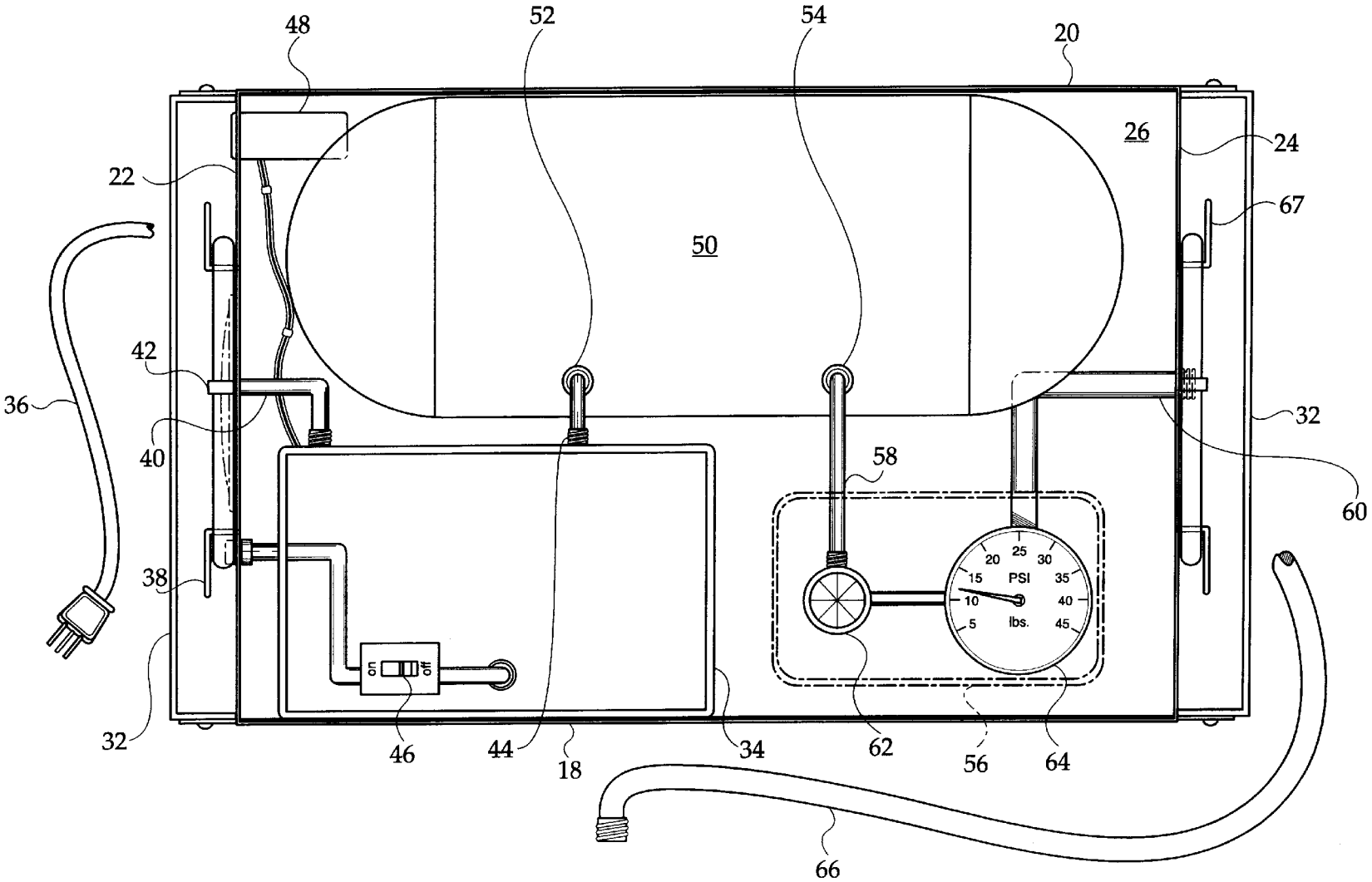
FIG. 3 is a cross-sectional plan view of the present invention.
Figure 4:
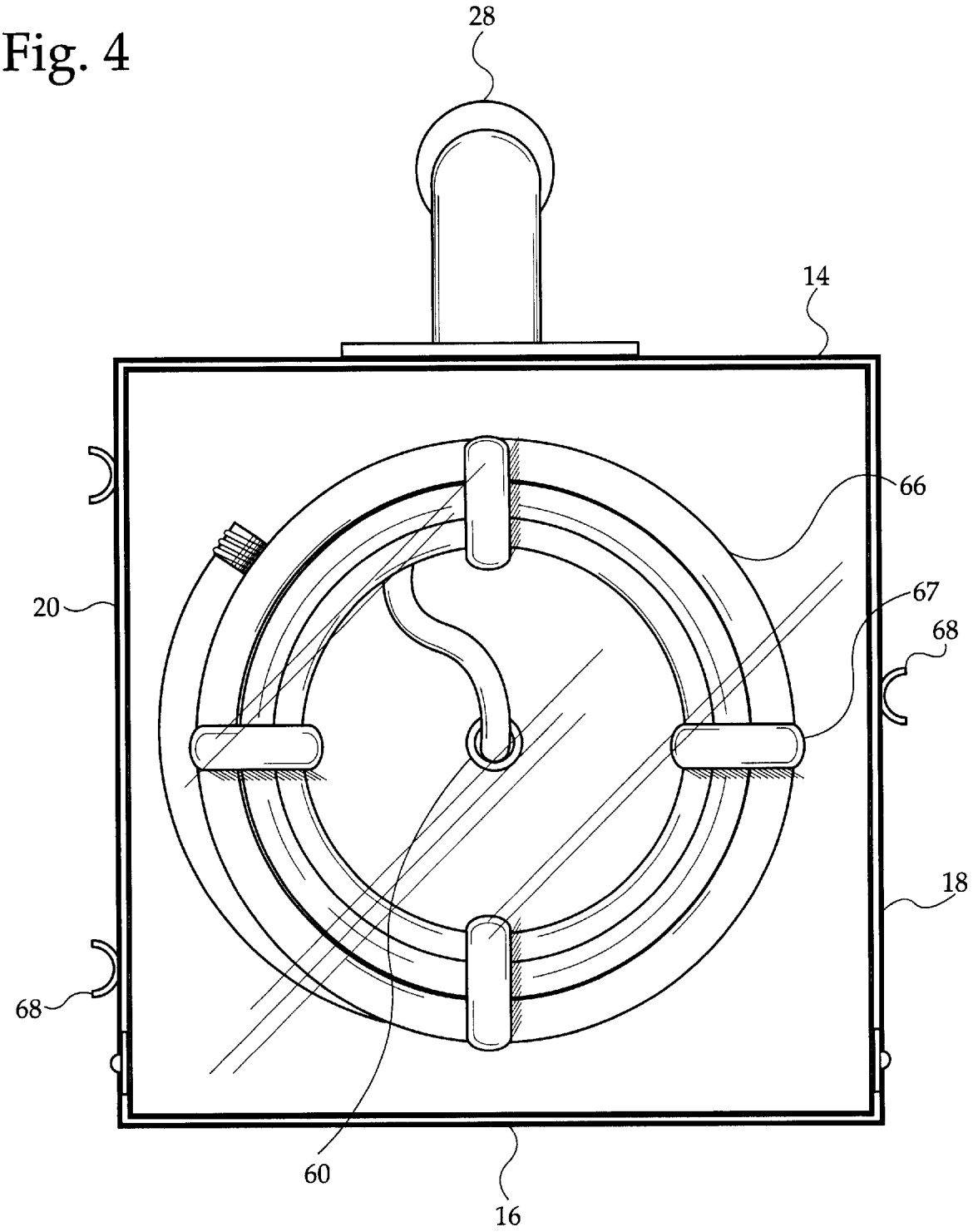
FIG. 4 is an elevated end view of the present invention.

It will be noted in the various figures that the device relates to a low pressure air cleaning system that allows a surface to be cleaned easily by blowing particulate matter from the surface. In its broadest context, the device consists of a housing, a motor, an air compression tank, a regulator, and an air hose. Such components are individually configured and correlated with respect to each other so as to attain the desired objective.

The housing 12 has a generally rectangular configuration defined by a top wall 14, a bottom wall 16, a front wall 18, a back wall 20, a first end wall 22, and a second end wall 24. The housing 12 has a hollow interior 26. The top wall 14 has a generally L-shaped handle 28 extending upwardly therefrom. The bottom wall 16 has a plurality of support feet 30 extending downwardly therefrom. The first and second end walls 22,24 each have a removable cover member 32 coupled thereto.

The motor 34 is disposed within the hollow interior 26 of the housing 12. The motor 34 has a power cord 36 extending outwardly of the first end wall 22 of the housing 12. The power cord 36 includes a cord mount 38 secured to the first end wall 22 for wrappedly receiving the power cord 36 thereon. The motor 34 includes an air intake 40. The air intake 40 has an open outer end 42 extending outwardly of the first end wall 22. The motor 34 includes an air outlet 44. The motor 34 has a power switch 46 disposed in the top wall 14 of the housing 12. The motor 34 includes a fuse 48 removably disposed within the first end wall 22 of the housing 12. The power cord 36 is disposed interiorly of the cover member 32 of the first end wall 22 when not in use.

An air compression tank 50 is disposed within the hollow interior 26 of the housing 12. The air compression tank 50 has an air inlet 52 in communication with the air outlet 44 of the motor 34. The air compression tank 50 has an air outlet 54.

The regulator 56 is disposed within the hollow interior 26 of the housing 12. The regulator 56 has an air inlet 58 in communication with the air outlet 54 of the air compression tank 50. The regulator 56 includes an air outlet 60 extending outwardly of the second end wall 24 of the housing 12. The regulator 56 includes a control valve 62 and pressure gauge 64 disposed within the top wall 14 of the housing 12.

The air hose 66 is adapted for coupling with the air outlet 60 of the regulator 56. The air hose 66 includes a cord mount 67 secured to the second end wall 24 for wrappedly receiving the air hose 66 thereon. The air hose 66 includes a plurality of nozzle attachments adapted for being removably coupled therewith. The nozzle attachments include clips 68 secured to the front and back walls 18,20 of the housing 12 for receiving the nozzle attachments when not in use. The nozzle attachments include, but are not limited to standard nozzles 70, elongated nozzles 72, swivel nozzles 74, and tire inflation nozzles.

What is claimed is:

1. A low pressure air cleaning system that allows a surface to be cleaned easily by blowing particulate matter from the surface, comprising, in combination:

a housing having a generally rectangular configuration defined by a top wall, a bottom wall, a front wall, a back wall, a first end wall, and a second end wall, the housing having a hollow interior, the top wall having a generally L-shaped handle extending upwardly therefrom, the bottom wall having a plurality of support feet extending downwardly therefrom, the first and second end walls each having a removable cover member coupled thereto;

a motor disposed within the hollow interior of the housing, the motor having a power cord extending outwardly of the first end wall of the housing, the power cord including a cord mount secured to the first end wall for wrappedly receiving the power cord thereon, the motor including an air intake, the air intake having an open outer end extending outwardly of the first end wall, the motor including an air outlet, the motor having a power switch disposed in the top wall of the housing;

an air compression tank disposed within the hollow interior of the housing, the air compression tank having an air inlet in communication with the air outlet of the motor, the air compression tank having an air outlet;

a regulator disposed within the hollow interior of the housing, the regulator having an air inlet in communication with the air outlet of the air compression tank, the regulator including an air outlet extending outwardly of the second end wall of the housing, the regulator including a control valve and pressure gauge disposed within the top wall of the housing; and an air hose adapted for coupling with the air outlet of the regulator, the air hose including a cord mount secured to the second end wall for wrappedly receiving the air hose thereon, the air hose including a plurality of nozzle attachments adapted for being removably coupled therewith, the nozzle attachments including clips secured to the front and back walls of the housing for receiving the nozzle attachments when not in use.

2. A low pressure air cleaning system that allows a surface to be cleaned easily by blowing particulate matter from the surface, comprising, in combination:

a housing having a top wall, a bottom wall, a front wall, a back wall, a first end wall, and a second end wall;

a motor disposed within the housing, the motor having a power cord extending outwardly of the first end wall of the housing, the motor including an air intake, the air intake having an open outer end extending outwardly of the first end wall, the motor including an air outlet;

an air compression tank disposed within the housing, the air compression tank having an air inlet in communication with the air outlet of the motor, the air compression tank having an air outlet;

a regulator disposed within the housing, the regulator having an air inlet in communication with the air outlet of the air compression tank, the regulator including an air outlet extending outwardly of the second end wall of the housing; and an air hose adapted for coupling with the air outlet of the regulator.

3. The low pressure air cleaning system as set forth in claim 2, wherein the top wall of the housing has a handle extending upwardly therefrom.

4. The low pressure air cleaning system as set forth in claim 2, wherein the bottom wall of the housing has a plurality of support feet extending downwardly therefrom.

5. The low pressure air cleaning system as set forth in claim 2, wherein the first and second end walls of the housing each have a removable cover member coupled thereto.

6. The low pressure air cleaning system as set forth in claim 2, wherein the power cord of the motor includes a cord mount secured to the first end wall for wrappedly receiving the power cord thereon.

7. The low pressure air cleaning system as set forth in claim 2, wherein the motor has a power switch disposed in the top wall of the housing.

8. The low pressure air cleaning system as set forth in claim 2, wherein the regulator includes a control valve and pressure gauge disposed within the top wall of the housing.

9. The low pressure air cleaning system as set forth in claim 2, wherein the air hose includes a cord mount secured to the second end wall of the housing for wrappedly receiving the air hose thereon.

10. The low pressure air cleaning system as set forth in claim 2, wherein the air hose includes a plurality of nozzle attachments adapted for being removably coupled therewith.

11. The low pressure air cleaning system as set forth in claim 10, wherein the nozzle attachments includes clips secured to the front and back walls of the housing for receiving the nozzle attachments when not in use.

* * * * *